United States Patent [19]

Hayashi et al.

[11] 4,315,456

[45] Feb. 16, 1982

[54] AIR-CURTAINING APPARATUS FOR FIRE PROTECTION

[75] Inventors: Taro Hayashi, Nara; Aritsune Moriyama, Nishinomiya, both of Japan

[73] Assignee: Sanko Air Plant, Ltd., Osaka, Japan

[21] Appl. No.: 100,289

[22] Filed: Dec. 5, 1979

[51] Int. Cl.[3] ..... F24F 9/00

[52] U.S. Cl. ..... 98/36; 98/49; 98/50; 169/48

[58] Field of Search ..... 98/1, 36, 115 LH, 115 SB, 98/50, 49; 169/91, 48; 239/590

[56] References Cited

U.S. PATENT DOCUMENTS

| | | | |
|---|---|---|---|
| 1,731,289 | 10/1929 | Blair | 98/49 |
| 2,339,987 | 1/1944 | Evans | 98/49 |
| 3,425,335 | 2/1969 | Black | 98/36 X |
| 3,598,153 | 8/1971 | Hayashi et al. | 239/590 |
| 3,988,972 | 11/1976 | Goto et al. | 98/36 |
| 4,121,790 | 10/1978 | Graham | 98/36 X |

FOREIGN PATENT DOCUMENTS

| | | | |
|---|---|---|---|
| 253478 | 8/1964 | Australia | 98/36 |
| 1066166 | 10/1959 | Fed. Rep. of Germany | 98/50 |
| 52-47701 | 1/1977 | Japan | 98/50 |
| 365464 | 3/1973 | U.S.S.R. | 98/50 |

*Primary Examiner*—Albert J. Makay
*Assistant Examiner*—Harold Joyce
*Attorney, Agent, or Firm*—Benasutti Associates, Ltd.

[57] ABSTRACT

An apparatus for fire protection forming an air-curtain between a supply opening and a exhaust opening, wherein the relationship between the supply opening and the exhaust opening are as follows:

$1\ m \leqq L \leqq 5\ m$ $0.5\ L \leqq L_S \leqq 1.5\ L$ $1\ m/sec \leqq U_L \leqq 10\ m/sec$ $5\ m/sec \leqq U_D \leqq 30\ m/sec$ $U_L \leqq U_0 \leqq U_D$ wherein L represents the width of said supply opening in the direction parallel to said escape passage, $L_S$ represents the width of said exhaust opening in the direction parallel to said escape passage, $U_L$ represents the supply air flow velocity, $U_D$ represents the exhaust air flow velocity and $U_O$ represents the additional air flow velocity.

9 Claims, 13 Drawing Figures

AIR-CURTAINING APPARATUS FOR FIRE PROTECTION

SUMMARY OF THE INVENTION

The present invention relates to an air-curtain for fire protection, and more particularly, relates to an improved air-curtaining apparatus installed in fire escape passages in underground towns, department stores, supermarkets, and corridors or staircases of such public buildings, having the possibility of effectively protecting people from fire, smoke and gases in said fire escape passage.

In the case of a fire breaking out, for example, in an underground town, it has been well known that very often death by suffocation, shortage of oxygen etc. has been caused by fire and smoke.

At the present time, a mechanical type doorway is used which enables people to pass from the danger zone to a safety zone, and said doorway is closed after a predetermined time after fire initially breaks out. However, as can be easily understood, this is quite dangerous to any person remaining in the danger zone.

For this reason an air-curtaining apparatus, which is a kind of an open doorway, may be considered most suitable.

The aim of such an air-curtain for fire protection is primarily to allow people to escape without being overcome by smoke and gases during the early stage of the fire, and secondly shutting out and exhausting smoke and thirdly to make fire fighting easy.

However, the art of the known air-curtain does not provides for the functions of shutting out smoke and gases and rapiding exhausting smoke and gases. In other words, such functions of an air-curtain for fire protection cannot be achieved by only a push type air-curtain or only a pull type air-curtain for confining smoke and gases and exhausting them from the danger zone in the event of fire.

In order to solve the above described aim, an experiment was made using a push-pull type air-curtain. It was noted that the air flow ejected from a supply opening was sucked into an exhaust opening, and between the supply opening and the exhaust opening the push-pull type air-curtain was produced. Said air flow diverged as it advanced towards the exhaust opening and therefore it is necessary that the exhaust opening be of a size to receive the diverged air flow. Thus, the maintaining force of the air-curtain near the exhaust opening is weak.

In addition, side flows of air may be generated by air-drafts caused by temperature differences between the fire zone and other zones. Thus, should side flows exist outside the air-curtain, said maintaining force of air in the air-curtain becomes weaker. Therefore, in order to maintain a strong force of air in the air-curtain, said push-pull type air-curtain must be provided with strong, and thus large blowers in both the supply opening and the exhaust opening. This results in an expensive push-pull type air-curtain apparatus installation cost and in difficulty in installing the same in a comparatively narrow existing location.

Dimensions of the prior art push-pull type air-curtains comprise, for example, 0.05~0.1 m of depth of the air film, 30~100 m/sec of push flow velocity and 10~20 m/sec of suction flow velocity, and the velocity distribution of the push flow and the suction flow are uneven.

Hereinafter, the push-pull type air-curtain will be described simply as an air-curtain.

As mentioned above, the prior art air-curtain film is composed of an air flow with an uneven velocity distribution and the depth thereof is comparatively thin, so that when escapers pass through said air-curtain film, it is apt to be easily broken and thereby permit some quantity of smoke and gases to leak therethrough. Furthermore, as the air flow has a thin depth and an uneven velocity distribution, it is quite difficult to maintain the force of the air flow and to suck the smoke and gases into the exhaust opening.

From our repeated experiments, it has been proved that, when the test is applied with two air-curtains having the same mass of the ejected flow and having the air films of different thickness, shutout action and exhaust action of the air-curtain with the thicker air film are more effective than that of the air-curtain with the thinner air film.

Even if the thickness of the air-curtain is thick enough to accomplish the above two actions, said air-curtain will be broken by the continuous passing of the escapers through the escape passage. To avoid this, the air-curtain of the present invention should be provided with a uniform air velocity distribution comprised of a plurality of parallel air flow lines, and this air velocity distribution shuts out smoke and gases and effectively exhausts said smoke and gases.

OBJECT OF THE INVENTION

Accordingly, it is a principal object of the present invention to obviate the aforementioned disadvantages by providing an improved air-curtaining apparatus for fire protection.

It is another object of the present invention to produce an escape zone which is not contaminated with smoke and gases.

It is another object of the present invention to provide a visible escape passage so as not to cause a state of confusion in the escapers.

It is another object of the present invention to prevent the fire from spreading.

It is another object of the present invention to have adequate dimensions and relationships of the positions between the supply opening and exhaust opening.

It is another object of the present invention to provide a thick air-curtain which will not be broken by a continuous passing of escapers therethrough.

It is another object of the present invention to use minimum power consumption and to have a low installation cost, and to require only a small floor space.

In order to fulfill the above described objects, the air-curtaining apparatus for fire protection of the present invention comprises a means defining substantially a rectangular shaped supply opening to eject an air flow in the form of an air-curtain with uniform air velocity distribution across the cross-sectional area of said supply opening, a supply duct connecting said supply opening to an air-supply fan means, a means defining substantially a rectangular shaped exhaust opening of a dimension to receive both said air-curtain and additional air from the surroundings sucked in by said air-curtain, with uniform air velocity distribution, said exhaust opening and said supply opening are spaced apart and are opposite to each other, a first exhaust duct connecting said exhaust opening to an air-exhaust fan means, a second duct connecting said air-exhaust fan means to open air, and the relationships of the positions between said supply opening and exhaust opening and the dimensions of the two being expressed as follows:

$1\ m \leqq L \leqq 5\ m$ $0.5\ L \leqq L_S \leqq 1.5\ L$ $1\ m/sec \leqq U_L \leqq 10\ m/sec$ $5\ m/sec \leqq U_D \leqq 30\ m/sec$ $U_L \leqq U_O \leqq U_D$ wherein L represents the width of said supply opening in the direction parallel to said escape passage, $L_S$ represents the width of said exhaust opening in the direction parallel to said escape passage, $U_L$ represents the push flow velocity, $U_D$ represents the suction flow velocity and $U_O$ represents the said flow velocity.

Other and further objects, features and advantages of the present invention will appear more fully from the following description.

BRIEF DESCRIPTION OF THE DRAWINGS

Preferred embodiments of the invention will now be described in detail with reference to the accompanying drawings, wherein the same reference numerals are used to designate similar parts throughout the several views, in which.

DESCRIPTION OF THE PREFERRED EMBODIMENTS

Figure 1:
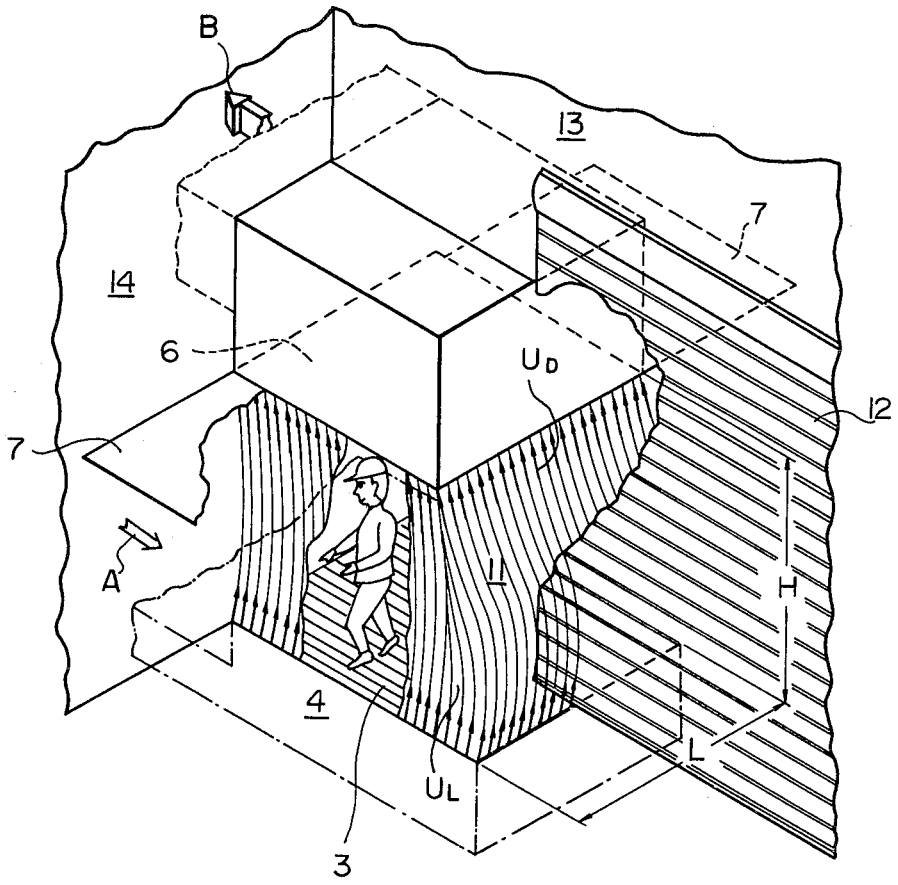
FIG. 1 is a general perspective view showing an embodiment of an air-curtaining apparatus according to the present invention, but the air supply fan, air exhaust fan and the terminal exhaust conduit being omitted for the purpose of clarity.
Figure 2:
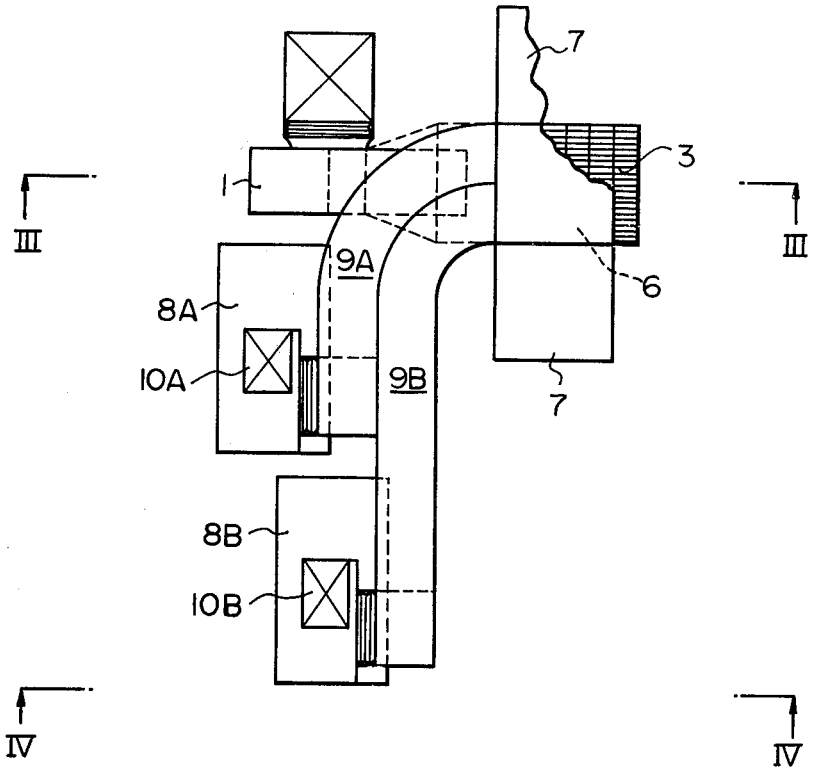
FIG. 2 is a schematic plan view of FIG. 1.
Figure 3:
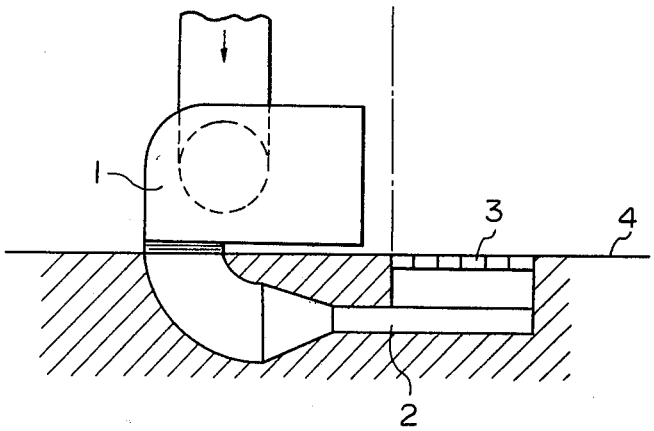
FIG. 3 is a cross-sectional view taken substantially on line III—III of FIG. 2.
Figure 4:
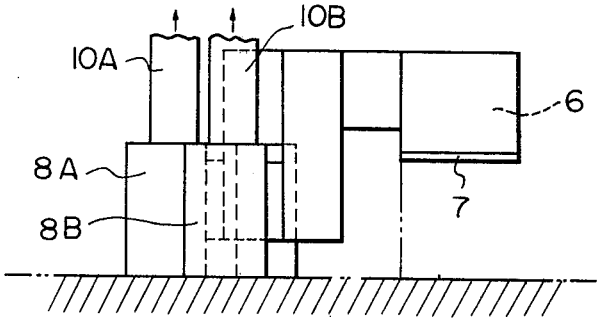
FIG. 4 is a side view taken substantially on line IV—IV of FIG. 2.
Figure 5:
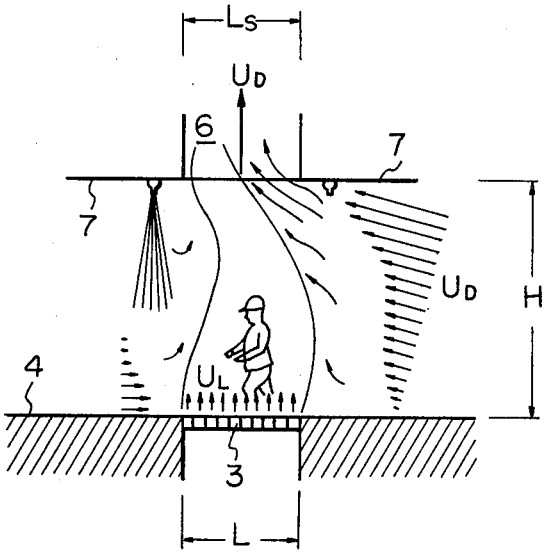
FIG. 5 is an explanatory front view of an air-curtaining apparatus according to the present invention.
Figure 6:
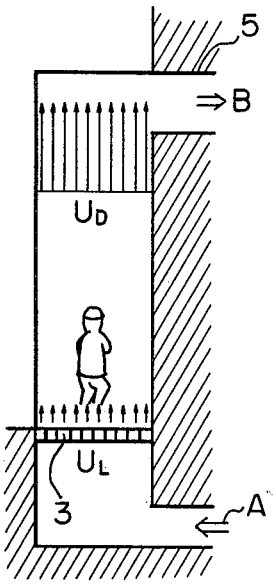
FIG. 6 is a side view of FIG. 5.
Figure 7:
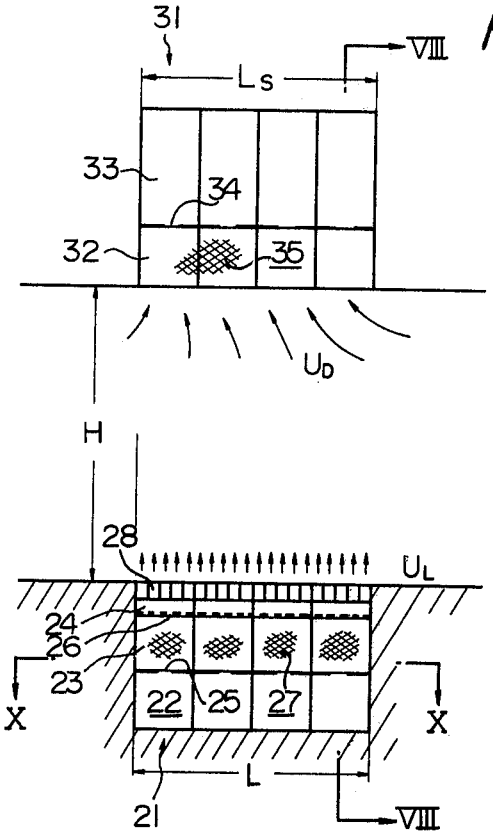
FIG. 7 is an enlarged front view showing the air supply means and air exhaust means of FIG. 5.
Figure 7A:
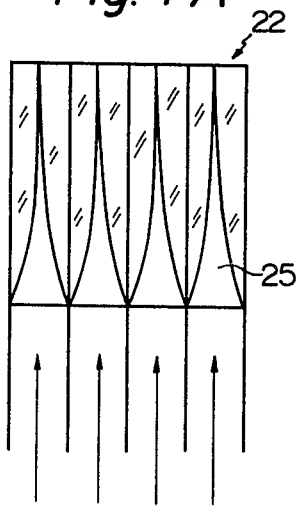
FIG. 7A is a plane view taken substantially on line X—X of FIG. 7.
Figure 8:
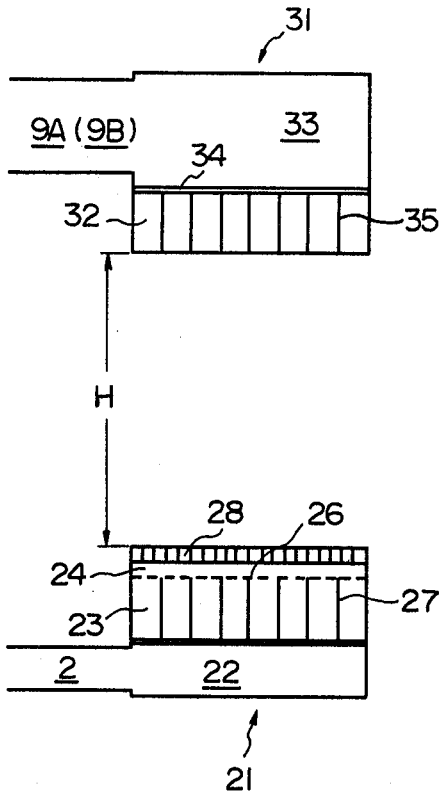
FIG. 8 is a cross-sectional view taken substantially on line VIII—VIII of FIG. 7.
Figure 9:
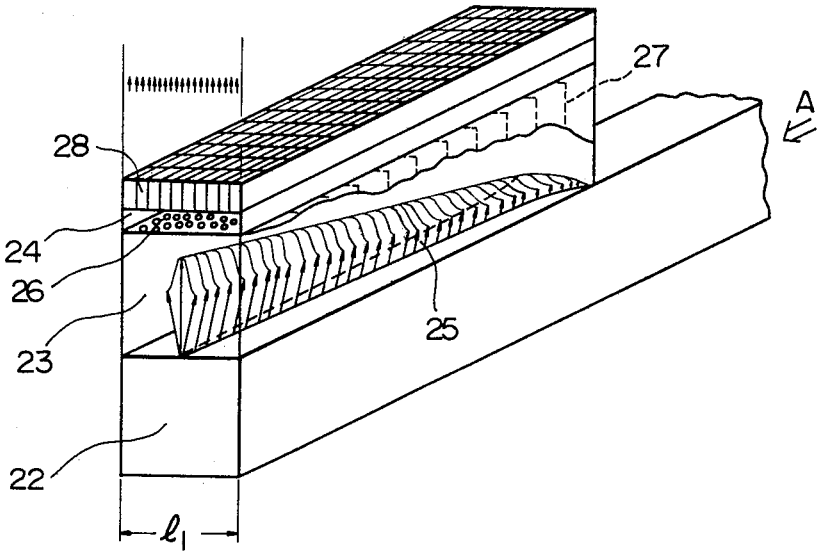
FIG. 9 is a perspective view of the air supply means of FIG. 7.

FIGS. 1 through 6 show a first embodiment of an air-curtaining apparatus according to the present invention. In these cases, an air flow forming air-curtain is advanced from the floor side to the ceiling side. As the side flow of smoke near the ceiling is faster than the flow of smoke near the floor, the air-curtain advantageously is designed so that the air flow is sucked into in the ceiling, and this way is affirmed also from the fact that smoke has a buoyancy because of its temperature (FIG. 5).

Referring to the several drawings, the ambient air supplied by a supply fan 1 is conducted through a supply duct 2 to a rectangular shaped supply opening 3 disposed on the floor surface 4, for example, of an underground town. Also, a rectangular shaped exhaust opening 6 with pent-roofs (7, 7) is disposed under the ceiling surface 5. Said exhaust opening 6 or pull hood and said supply opening 3 are spaced apart and are opposite to each other. The exhaust opening is connected to exhaust fans 8A and 8B through first exhaust ducts 9A and 9B, in turn, the exhaust fans 8A and 8B are communicated with the ambient air through second exhaust ducts 10A and 10B, respectively. In the present case, two sets of exhaust units are provided to increase the exhaust or suction flow rate. Preferably, the exhaust flow rate per such unit is more than 1000 $m^3$/min.

Being ejected from the supply opening 3, the air is sucked into the exhaust opening 6 forming a block-shaped air-curtain 11. The numeral 12 denotes a shutter made from a plurality of thin steel plates. The numeral 13 is a hang wall which is disposed perpendicular to a side wall 14.

Said air supply and air exhaust openings are disposed among the shutter 12, the hang wall 13 and the side wall 14. It is noted that the aforementioned mechanical type doorway is replaced by the air-curtaining apparatus of the present invention. Said pent-roofs (7, 7) are arranged in symmetry with respect to the vertical plane passing the neutral line of the hang wall 13. One of said pent-roofs (7, 7), positioned in the safety zone, can be utilized successfully in reducing the amount of fruitless air flow being sucked into the exhaust opening 6. The arrow marks A and B indicate the directions of the supply air flow and the exhaust air flow, respectively.

According to our repeated tests, it was confirmed that the air-curtaining apparatus of the present invention is an effective fire escape means.

Provided that L is the width of the supply opening in the direction parallel to said escape passage, $L_S$ is the width of the exhaust opening in the direction parallel to the escape passage, $U_L$ is the push flow velocity, $U_D$ is the suction flow velocity and $U_O$ is side flow velocity, the recommended relationships of the positions of the air supply means and the air exhaust means and the dimensions of the two are as follows:

$$1\ m \leqq L \leqq 5\ m \quad (1)$$

$$0.5\ L \leqq L_S \leqq 1.5\ L \quad (2)$$

$$1\ m/sec \leqq U_L \leqq 10\ m/sec \quad (3)$$

$$5\ m/sec \leqq U_O \leqq 30\ m/sec \quad (4)$$

$$U_L \leqq U_O \leqq U_D \quad (5)$$

Preferably, the values of L and $L_S$ are respectively 2 m. Provided that the height of the escape passage H is 2 m, and the practical range of the side flow velocity $U_O$ is between 5 m/sec ~ 10 m/sec, the preferable range of the push flow velocity $U_L$ and the suction flow velocity $U_D$ are 2.5 m/sec ~ 5 m/sec and 10 m/sec ~ 20 m/sec, respectively. Height of the escape passage H, i.e. length between the supply opening and the exhaust opening, can be adequately selected in conformity to the height of the escapers.

In order to obtain effective supply and exhaust flows, the air-curtaining apparatus of the present invention should be provided with the following.

A. Air velocity distribution of the supply flow along both the widthwise direction and the direction perpendicular to said widthwise direction of the supply opening should be uniform.

B. Air velocity distribution of the exhaust flow along the direction perpendicular to the widthwise direction of the exhaust opening should be uniform.

Referring to FIGS. 7 through 10, the construction of the air supply means and air exhaust means according to the present invention is shown.

The air supply means can be divided into four units (21, 21 . . . ) by partition walls disposed therebetween. Each of said unit 21 includes a first flow-rate equalizing means 22, a first chamber 23 for flow rectification and a second chamber 24 for flow rectification disposed above the first chamber 23. Said first flow-rate equalizing means 22 is provided with a flow-passing cutoff 25 formed in the shape of an isosceles triangle, whose effective area for flow-passing is decreased gradually along the flow direction, and the wider side of the cutoff is connected to the supply duct 2. Said first flow-rate equalizing means 22 is designed to generate an equalized flow rate of the supplied air across the longitudinal direction of said means 22, and the function and effect of the same is particularly described in the U.S. Pat. No. 3,598,153 which is an invention by the same inventors of the present invention.

Above said means 22, the first chamber 23 for flow rectification is disposed. Said first chamber 23 is covered with a perforated plate 26 at the top surface thereof, and is provided with a plurality of vertical rectifier plates 27 disposed therein.

The second chamber 24 for flow rectification disposed above said first chamber 23 is provided with a grille at the top surface thereof. The top surface of the grille 28 is substantially situated on the floor level 4.

The air exhaust means also is provided with four units (31, 31 . . . ) separated by partition walls disposed therebetween. Each of said unit 31 includes a second flow-rate equalizing means 32 and an exhaust chamber 33 disposed above the equalizing means 32.

Said second flow-rate equalizing means 32 is provided with a flow-passing cutoff 34 at the top surface thereof, with a plurality of vertical rectifier plates 35 disposed therein. Said second flow-rate equalizing means 32 is designed to generate an equalized flow rate of the exhaust air across the longitudinal direction of said means 32, and the function and effect of the means 32 are almost same as those of the first flow-rate equalizing means 22. In this case, said cutoff 34 is formed in the shape of an isosceles triangle and is diverged towards the direction of the exhaust air flow. Divided exhaust chambers (33, 33 . . . ) are connected to the exhaust ducts 9A and 9B.

In the embodiment of the present invention, said air supply means and air exhaust means are respectively divided into four chambers, however, these means may be divided into any suitable number of chambers.

In the operation of the air supply means, the air flow is ejected through the first flow-rate equalizing means 22 into first chamber 23. Thus, the first chamber 23 is fully filled with the air flow having an equalized flow rate of the supplied air. Then the fully filled air flow is conducted into the second chamber 24, and air flow coming out from said second chamber 24 makes an air-curtain with a completely uniform air velocity distribution. During such transferring of the air flow, the perforated plate 26 and the grille 28 rectify such air flow.

Figure 10:
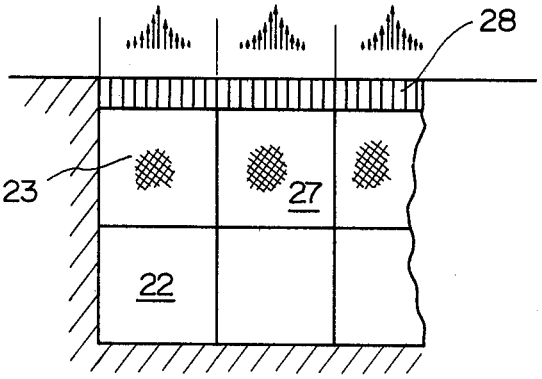
FIG. 10 is an explanatory front view of the air supply means when the perforated plate is not provided.

Should the perforated plate 26 not be provided in the air supply means, an uneven air velocity distribution of the air flow occurs in place of a uniform air velocity distribution. Such a case is shown in FIG. 10.

Figure 11:
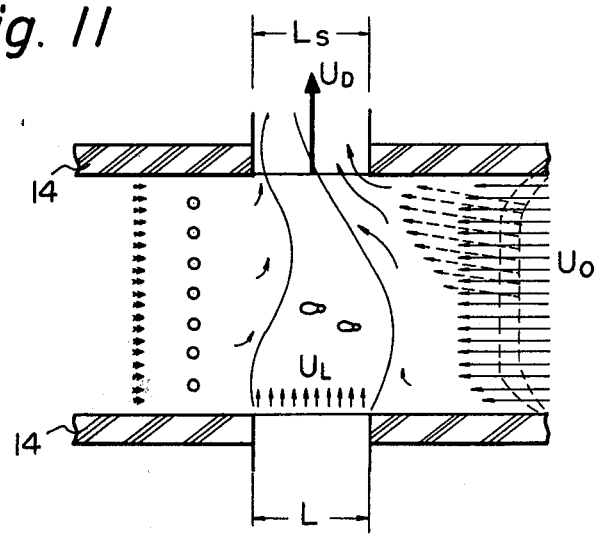
FIG. 11 is a front view showing another embodiment of an air-curtaining apparatus according to the present invention, but the attachments thereof being omitted for the purpose of clarity.
Figure 12:
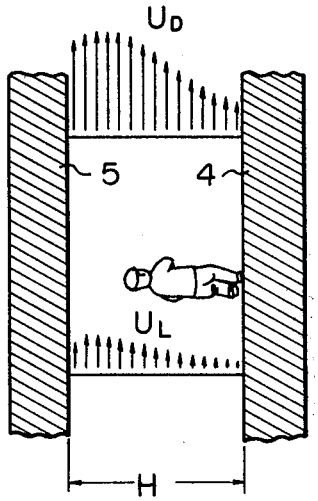
FIG. 12 is a side view of FIG. 10.

Referring to FIGS. 11 and 12, a second embodiment of the present invention is shown. In this case the air-curtaining apparatus is applied to a corridor of a public building.

As shown in FIG. 5 the side flow of smoke is directed to the ceiling, and the side flow of the smoke which runs near the ceiling 5 is faster than the one which runs near the floor 4. Therefore, in order to overcome such side flow and to obtain an effective suction of the side flow, the air-curtaining apparatus of the present invention should be provided with the following.

A. Air velocity distribution of the supply flow along the widthwise direction of the supply opening should be uniform.

B. Air velocity distribution of the supply flow along the heightwise direction of the supply opening should be uniform, or preferably being higher in the vicinity of the ceiling.

C. Air velocity distribution of the exhaust flow along the heightwise direction of the exhaust opening should be uniform, or preferably being higher in the vicinity of the ceiling.

As many apparently widely different embodiments of this invention may be made without departing from the spirit and scope thereof, it is to be understood that the present invention is not limited to the specific embodiments thereof except as defined in the appended claims.

What is claimed is:

1. An air-curtaining apparatus used in a fire escape passage of an underground town or the like so as to protect escapers from smoke and gases caused in the underground town by fire, said air-curtaining apparatus comprising:

a means defining a substantially rectangular shaped supply opening to eject an air flow in the form of an air-curtain with uniform air velocity distribution across the cross-sectional area of said supply opening;

a supply duct connecting said supply opening to an air-supply fan means;

a means defining a substantially rectangular shaped exhaust opening of a dimension to receive both said air-curtain and additional air attracted from the surroundings by said air-curtain, with uniform air velocity distribution, wherein said exhaust opening and said supply opening are spaced apart and are opposite to each other;

a first exhaust duct connecting said exhaust opening to an air-exhaust fan means; and a second exhaust duct connecting said air-exhaust fan means to open air;

wherein the relationships between said supply opening and said exhaust opening are as follows:

$1\ m \leqq L \leqq 5\ m$ $0.5\ L \leqq L_S \leqq 1.5\ L$ $1\ m/sec \leqq U_L \leqq 10\ m/sec$ $5\ m/sec \leqq U_D \leqq 30\ m/sec$ $U_L \leqq U_O \leqq U_D$ and wherein L represents the width of said supply opening in the direction parallel to said escape passage, $L_S$ represents the width of said exhaust opening in the direction parallel to said escape passage, $U_L$ represents the supply air flow velocity, $U_D$ represents the exhaust air flow velocity and $U_O$ represents the additional air flow velocity.

2. An air-curtaining apparatus as claimed in claim 1, in which said supply opening and said exhaust opening are respectively disposed on horizontal planes parallel to each other.

3. An air-curtaining apparatus as claimed in claim 2, in which said supply opening and said exhaust opening are respectively disposed on the floor and in the vicinity of a ceiling.

4. An air-curtaining apparatus as claimed in claim 1, in which said supply opening and said exhaust opening are respectively disposed on vertical planes parallel to each other.

5. An air-curtaining apparatus used in a fire escape passage of a underground town or the like so as to protect escapers from smoke and gases caused in the underground town by fire, said air-curtaining apparatus comprising:

a supply means defining a supply opening to eject an air flow in the form of an air-curtain with a uniform air velocity distribution across the cross-sectional area of said supply opening, said supply means including a first flow-rate equalizing means, a perforated plate and a grille disposed one above the other;

a supply duct connecting said supply means to an air-supply fan means;

an exhaust means defining an exhaust opening of a size to receive both said air-curtain and additional air attracted from the surroundings by said air-curtain, with uniform air velocity distribution, wherein said exhaust means includes a second flow-rate equalizing means and an exhaust chamber disposed one above the other, and said exhaust opening and said supply opening are spaced apart and are opposite to each other;

a first exhaust duct connecting said exhaust means to an air-exhaust fan means; and a second exhaust duct connecting said air exhaust means to open air.

6. An air-curtaining apparatus as claimed in claim 5, in which each of said first and second flow-rate equalizing means defines substantially an isosceles triangle, whose effective flow-passing area decreases gradually along the flow direction.

7. An air-curtaining apparatus used in a fire escape so as to protect escapers from smoke and gases caused by fire, said air-curtaining apparatus comprising:

a passage defining a means for escaping from an area containing said smoke and gases caused by said fire;

a means defining a substantially rectangular shaped supply opening corresponding with said escape passage, to eject an air flow in the form of an air-curtain with uniform air velocity distribution across the cross-sectional area of said supply opening;

a supply duct connecting said supply opening to an air-supply fan means;

a means defining a substantially rectangular shaped exhaust opening corresponding with said escape passage, of a dimension to receive both said air-curtain and additional air attracted from the surroundings by said air-curtain, with uniform air velocity distribution across the cross-sectional area of said exhaust opening, wherein said exhaust opening and said supply opening are spaced apart and are opposite to each other;

a first exhaust duct connecting said exhaust opening to an air-exhaust fan means; and a second exhaust duct connecting said air-exhaust fan means to open air;

wherein the relationships between said supply opening and said exhaust opening are as follows:

$1\ m \leqq L \leqq 5\ m$ $0.5\ L \leqq L_S \leqq 1.5\ L$ $1\ m/sec \leqq U_L \leqq 10\ m/sec$ $5\ m/sec \leqq U_D \leqq 30\ m/sec$ $U_L \leqq U_O \leqq U_D$ and wherein L represents the width of said supply opening in the direction parallel to said escape passage, $L_S$ represents the width of said exhaust opening in the direction parallel to said escape passage, $U_L$ represents the supply air flow velocity, $U_D$ represents the exhaust air flow velocity and $U_O$ represents the additional air flow velocity.

8. An air-curtaining apparatus as claimed in claim 7, in which said supply opening includes pent-roof means operatively associated therewith.

9. An air-curtaining apparatus used in a fire escape so as to protect escapers from smoke and gases caused by fire, said air-conditioning apparatus comprising:

a passage defining a means for escaping from an area containing said smoke and gases caused by said fire;

a supply means defining a supply opening which corresponds with said escape passage and which ejects an air flow in the form of an air-curtain with a uniform air velocity distribution across the cross-sectional area of said supply opening, said supply means including a first flow-rate equalizing means, a perforated plate and a grille disposed one above the other;

a supply duct connecting said supply means to an air-supply fan means;

an exhaust means defining an exhaust opening which corresponds with said passage and of a size to receive both said air-curtain and additional air attracted from the surroundings by said air-curtain, with uniform air velocity distribution across the cross-sectional area of said exhaust opening, wherein said exhaust means includes a second flow-rate equalizing means and an exhaust chamber disposed one above the other, and said exhaust opening and said supply opening are spaced apart and are opposite to each other;

a first exhaust duct connecting said exhaust means to an air-exhaust fan means; and a second exhaust duct connecting said air exhaust means to open air.

* * * * *